US008366158B2

(12) United States Patent
Chen

(10) Patent No.: US 8,366,158 B2
(45) Date of Patent: Feb. 5, 2013

(54) LATCH DIRECTION CHANGE STRUCTURE OF LOCK

(76) Inventor: Te-Yu Chen, Pintung (TW)

( * ) Notice: Subject to any disclaimer, the term of this patent is extended or adjusted under 35 U.S.C. 154(b) by 342 days.

(21) Appl. No.: 12/715,313

(22) Filed: Mar. 1, 2010

(65) Prior Publication Data

US 2011/0210566 A1 Sep. 1, 2011

(51) Int. Cl.
*E05B 15/00* (2006.01)
*E05B 15/10* (2006.01)

(52) U.S. Cl. ..... 292/244; 292/163; 292/DIG. 60

(58) Field of Classification Search ..... 292/1, 1.5, 292/57, 60, 61, 163, 169, 244, DIG. 53, DIG. 54, 292/DIG. 60, DIG. 61; 70/461, 462
See application file for complete search history.

(56) References Cited

U.S. PATENT DOCUMENTS

| | | | | | |
|---|---|---|---|---|---|
| 1,627,420 | A | * | 5/1927 | Thomas | 70/107 |
| 2,483,368 | A | * | 9/1949 | Ledin | 292/165 |
| 2,521,835 | A | * | 9/1950 | Deal | 16/193 |
| 2,622,908 | A | * | 12/1952 | Lickteig, Jr. | 292/244 |
| 2,823,538 | A | * | 2/1958 | Fresard | 70/462 |
| 3,036,850 | A | * | 5/1962 | Schmid | 292/244 |
| 3,257,136 | A | * | 6/1966 | Russell et al. | 292/244 |
| 3,361,462 | A | * | 1/1968 | Foster | 292/165 |
| 3,361,464 | A | * | 1/1968 | Foster | 292/245 |
| 3,369,278 | A | * | 2/1968 | Humphreys | 24/163 R |
| 4,419,792 | A | * | 12/1983 | Kohli | 24/170 |
| 4,419,872 | A | * | 12/1983 | Plifka | 70/18 |
| 4,687,239 | A | * | 8/1987 | Lin | 292/172 |
| 4,846,615 | A | * | 7/1989 | Forsyth | 411/355 |
| 4,879,889 | A | * | 11/1989 | DeForrest, Sr. | 70/56 |
| 4,988,133 | A | * | 1/1991 | Shih | 292/191 |
| 5,113,676 | A | * | 5/1992 | Panossian | 70/418 |
| 5,123,684 | A | * | 6/1992 | Yeh | 292/244 |
| 5,342,101 | A | * | 8/1994 | Shih | 292/165 |
| 5,546,777 | A | * | 8/1996 | Liu et al. | 70/257 |
| 5,604,970 | A | * | 2/1997 | Aigner et al. | 29/525 |
| 5,666,830 | A | * | 9/1997 | Litvin | 70/129 |
| 5,678,870 | A | * | 10/1997 | Pelletier | 292/244 |
| 5,979,948 | A | * | 11/1999 | Aramburu | 292/1.5 |
| 6,349,982 | B2 | * | 2/2002 | Fayngersh et al. | 292/165 |
| 6,557,909 | B2 | * | 5/2003 | Morris | 292/169.15 |
| 6,662,603 | B2 | * | 12/2003 | Morris | 70/107 |
| 7,108,300 | B2 | * | 9/2006 | Hodgin et al. | 292/244 |
| 7,510,222 | B2 | * | 3/2009 | Hodgin et al. | 292/244 |
| 7,874,189 | B2 | * | 1/2011 | Martin | 70/85 |
| 2006/0043739 | A1 | * | 3/2006 | Gogel | 292/148 |
| 2006/0226663 | A1 | * | 10/2006 | Liao | 292/341.16 |
| 2007/0040394 | A1 | * | 2/2007 | Weselak | 292/292 |
| 2007/0114800 | A1 | * | 5/2007 | Kuo | 292/244 |
| 2008/0042452 | A1 | * | 2/2008 | Moon et al. | 292/337 |
| 2008/0246288 | A1 | * | 10/2008 | Hodgin et al. | 292/244 |
| 2009/0189399 | A1 | * | 7/2009 | Hodgin et al. | 292/244 |
| 2010/0140962 | A1 | * | 6/2010 | Kim | 292/165 |
| 2011/0210566 | A1 | * | 9/2011 | Chen | 292/244 |

* cited by examiner

*Primary Examiner* — Carlos Lugo
(74) *Attorney, Agent, or Firm* — Leong C. Lei

(57) ABSTRACT

A latch direction change structure of lock includes a fixed member and a movable member each having front and rear vertical walls that form through holes and a horizontal connection wall connected between the front and rear vertical walls. The fixed member forms symmetrically arranged slots in a circumference of the through hole of the rear vertical wall thereof. A bar is set through the through hole of the fixed member, receives a spring to fit thereon, and further extends through the through hole of the movable member to attach to a latch. When the latch is frontward pulled with respect to a lock case, the movable member is movable along the fixed member to allow the latch to separate from the lock case for selective rotation of 180 degrees. The slots defined in the rear vertical wall of the fixed member provides a function of properly positioning the latch.

3 Claims, 5 Drawing Sheets

LATCH DIRECTION CHANGE STRUCTURE OF LOCK

TECHNICAL FIELD OF THE INVENTION

The present invention generally relates to a direction change structure for a latch of lock, and more particularly to a latch direction change structure that allows the latch to be fit for both leftward and rightward opening operation of a lock by allowing the latch to be frontward pulled with respect to a case of the lock for selective rotation of the latch for 180 degrees.

DESCRIPTION OF THE PRIOR ART

A conventional door lock comprises a knob or handle that is arranged to be leftward or rightward openable according to the installation of the door panel to which the lock is mounted. The door lock also comprises a latch that is arranged in such a way to correspond to the arrangement of the handle or knob. Thus, a lock is only operable for a door of either leftward opening or rightward opening and the same conventional lock does not work for both leftward and rightward opening door. A lock manufacturer must manufacture two separate door locks for rightward opening operation and rightward opening operation in order to suit the needs of different orders. This increases the stocks of parts and thus raises the manufacturing costs. The present invention is thus made to overcome such a problem by providing a latch direction change structure for locks so that the installation and use of the locks are improved.

SUMMARY OF THE INVENTION

An objective of the present invention is to provide a latch direction change structure of lock, which allows for a simple operation of frontward pulling of the latch for selective rotation of 180 degrees of the latch so that the same lock is fit for both leftward and rightward opening operations.

According to the present invention, a latch direction change structure of lock comprises a fixed member, a movable member, and a bar attached to the latch. The fixed member and the movable member each have front and rear vertical walls that form through holes and a horizontal connection wall connected between the front and rear vertical walls. The fixed member forms a plurality of symmetrically arranged slots in a circumference of the through hole of the rear vertical wall thereof. The bar is set through the through hole of the fixed member, receives a spring to fit thereon, and further extends through the through hole of the movable member. When the latch is frontward pulled with respect to a case of the lock, the movable member is movable along the fixed member to allow the latch to separate from the lock case for selective rotation of 180 degrees. The slots defined in the rear vertical wall of the fixed member provides a function of properly positioning the latch. In this way, the same lock is fit for both leftward and rightward opening operations.

In the latch direction change structure of lock discussed above, the case of the lock is provided with a retention member that is positioned against a top edge of the rear vertical wall of the fixed member to retain the fixed member in position and thus allowing the movable member to move frontward.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
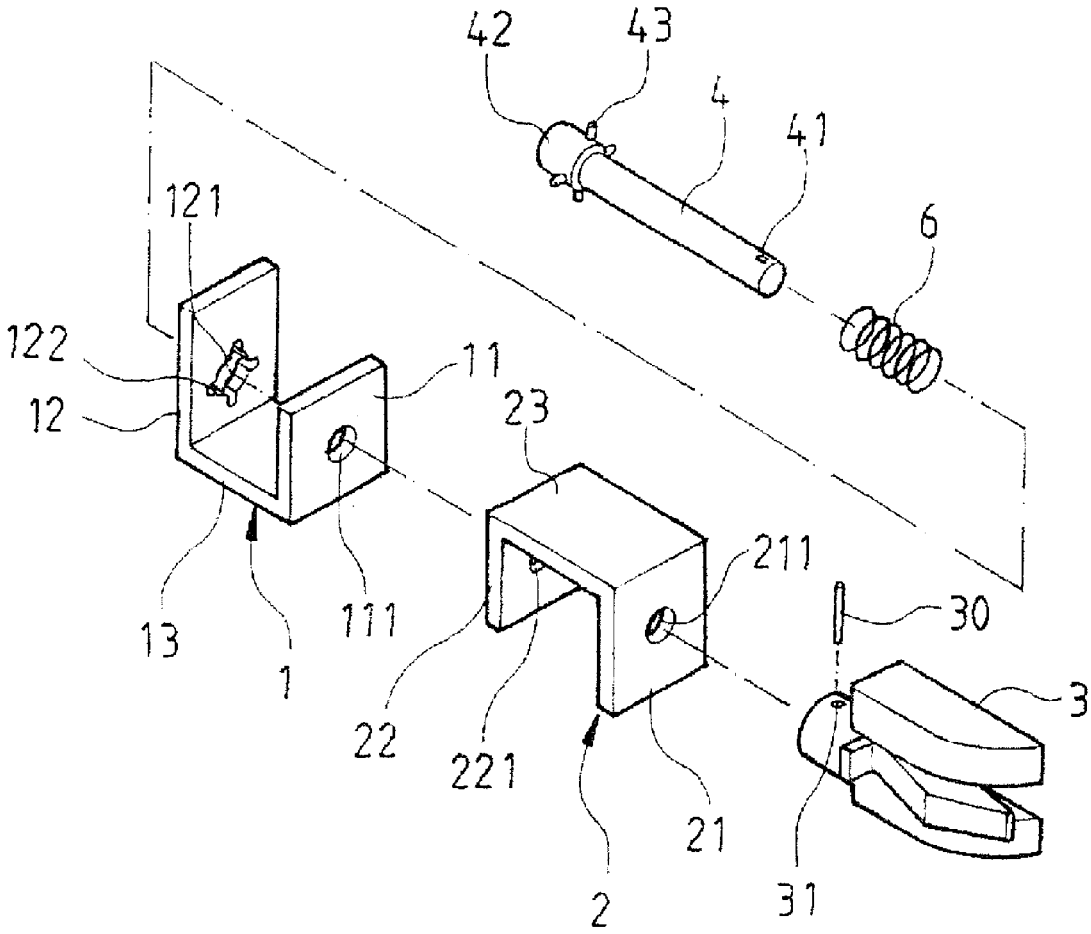
FIG. 1 is an exploded view of a latch direction change structure according to the present invention.
Figure 2:
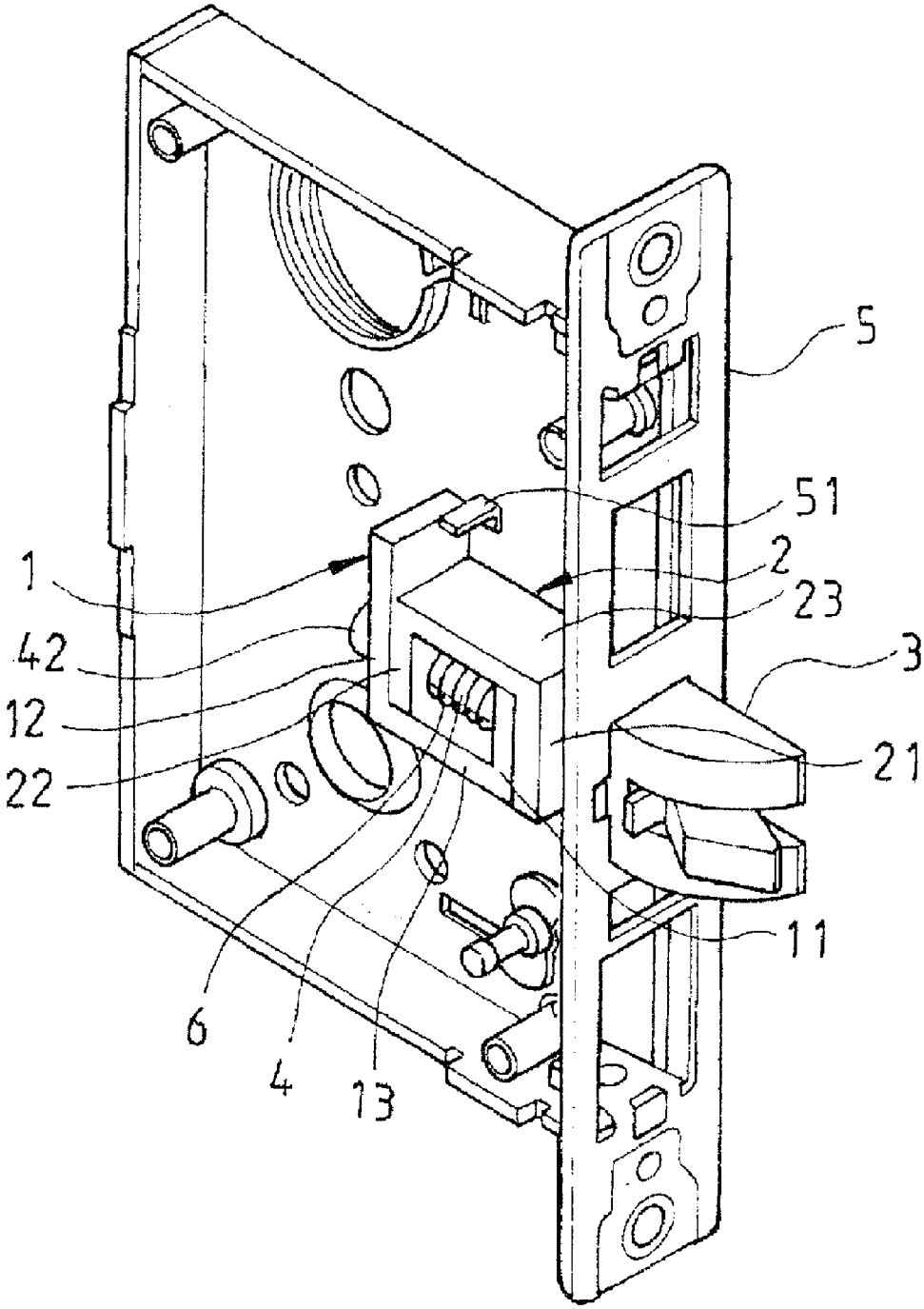
FIG. 2 is a perspective view of the latch direction change structure according to the present invention assembled in a lock.

Referring to FIGS. 1 and 2, an exploded view and a perspective view of the present invention are respectively shown. As shown, the present invention comprises a fixed member 1, a movable member 2, and a bar 4 connected to a latch 3. The fixed member 1 comprises a front vertical wall 11, a rear vertical wall 12, and a horizontal connection wall 13 connected between the front vertical wall 11 and the rear vertical wall 12. The front vertical wall 11 forms a through hole 111 and the rear vertical wall 12 forms a through hole 121 having a greater inside diameter. The rear vertical wall 12 also forms a plurality of slots 122 extending outward from a circumference of the through hole 121, preferably in a symmetric manner (the slots showing a cruciform arrangement in the embodiment illustrated).

The movable member 2 comprises a front vertical wall 21, a rear vertical wall 22, and a horizontal connection wall 23 connected between the front vertical wall 21 and the rear vertical wall 22. The front and rear vertical walls 21, 22 respectively forming through holes 211, 221 having inside diameters substantially corresponding to the through hole 111 of the fixed member 1.

The bar 4 has a front end section forming a radially extending pin hole 41, whereby a pin 30 extends through a positioning hole 31 defined in the latch 3 and the pin hole 41 to attach the latch 3 to the front end section of the bar 4. The bar has a rear end forming an expanded bar section 42. A plurality of positioning pegs 43 is formed on and extends outwards from the expanded bar section 42, preferably in a symmetric manner. The expanded bar section 42 is slightly smaller, in diameter, than the through hole 121 of the rear vertical wall 12 of the fixed member 1, and the positioning pegs 43 are arranged to respectively correspond to the slots 122 formed in the circumference of the through hole 121.

A case 5 is provided for the lock and comprises a retention member 51 set at a suitable location.

With the previously discussed components, the fixed member 1 and the movable member 2 are fit to each other in an opposing manner and the bar 4 is sequentially put through the through hole 121 of the fixed member 1, the through hole 221 of the movable member 2, a spring 6, the through hole 111 of the fixed member 1, and then the through hole 211 of the movable member 2, and is then attached to the latch 3, to have the retention member 51 positioned against a top edge of the rear vertical wall 12 of the fixed member 1. When the latch 3 is forcibly pulled frontward to be withdrawn out of the lock case 5, the movable member 2 is moved frontward by sliding along the fixed member 1 to have the latch 3 separated from the case 5, whereby the latch 3 is allowed to rotate by an angular displacement of 180 degrees. Afterwards, the bar 4 is allowed to return, fitting the positioning pegs 43 into the slots 122 of the rear vertical wall 12 of the fixed member 1 for positioning. In this way, the same lock is suitable for leftward and rightward opening operation.

Figure 3:
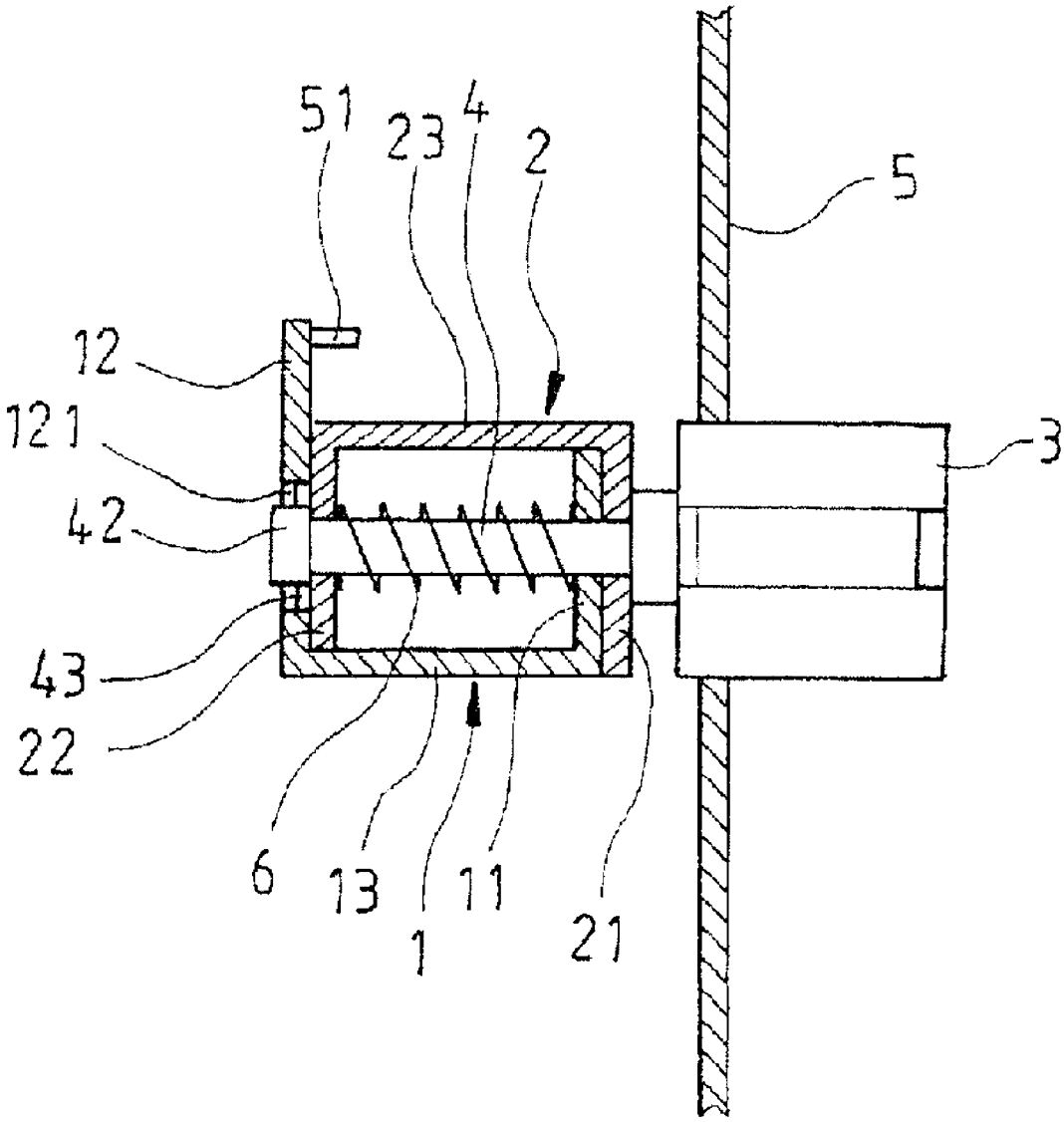
FIG. 3 is an assembled view, in a sectioned form, of the latch direction change structure according to the present invention.

Referring to FIG. 3, an assembled view, in a sectioned form, of the present invention is shown. In a normal assembled condition of the present invention, the movable member 2 is acted upon by a spring force of the spring 6 and is thus rearward biased to maintain in engagement with the rear vertical wall 12 of the fixed member 1 and thus keep the latch 3 inside case 5, whereby when a door to which the door is mounted is opened, the latch 3 cooperates with other mechanisms of the door lock to slide into and out of the lock to realize locking/unlocking of the door.

Figure 4:
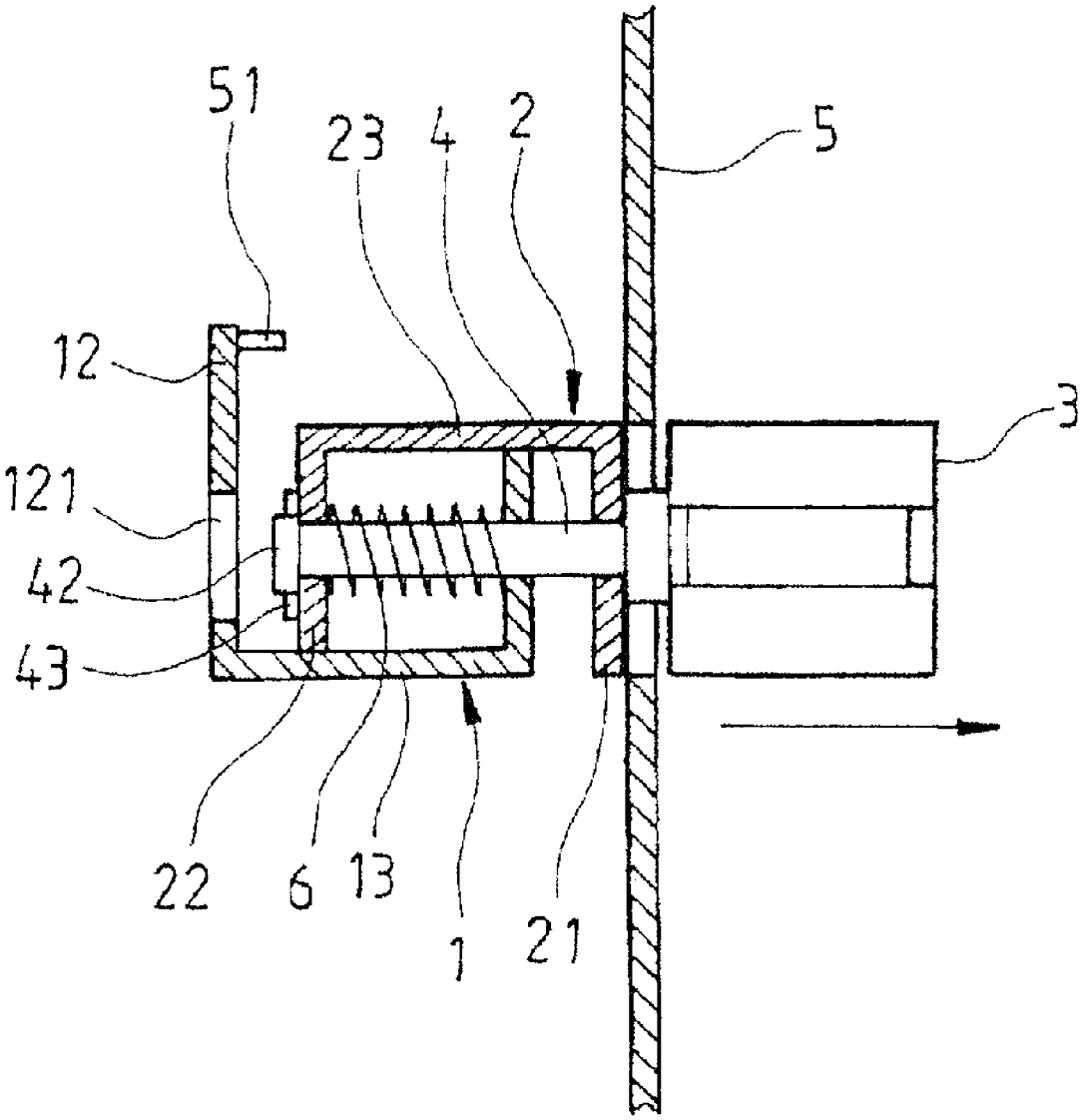
FIG. 4 is a cross-sectional view demonstrating a first phase of direction change operation of the latch direction change structure according to the present invention.
Figure 5:
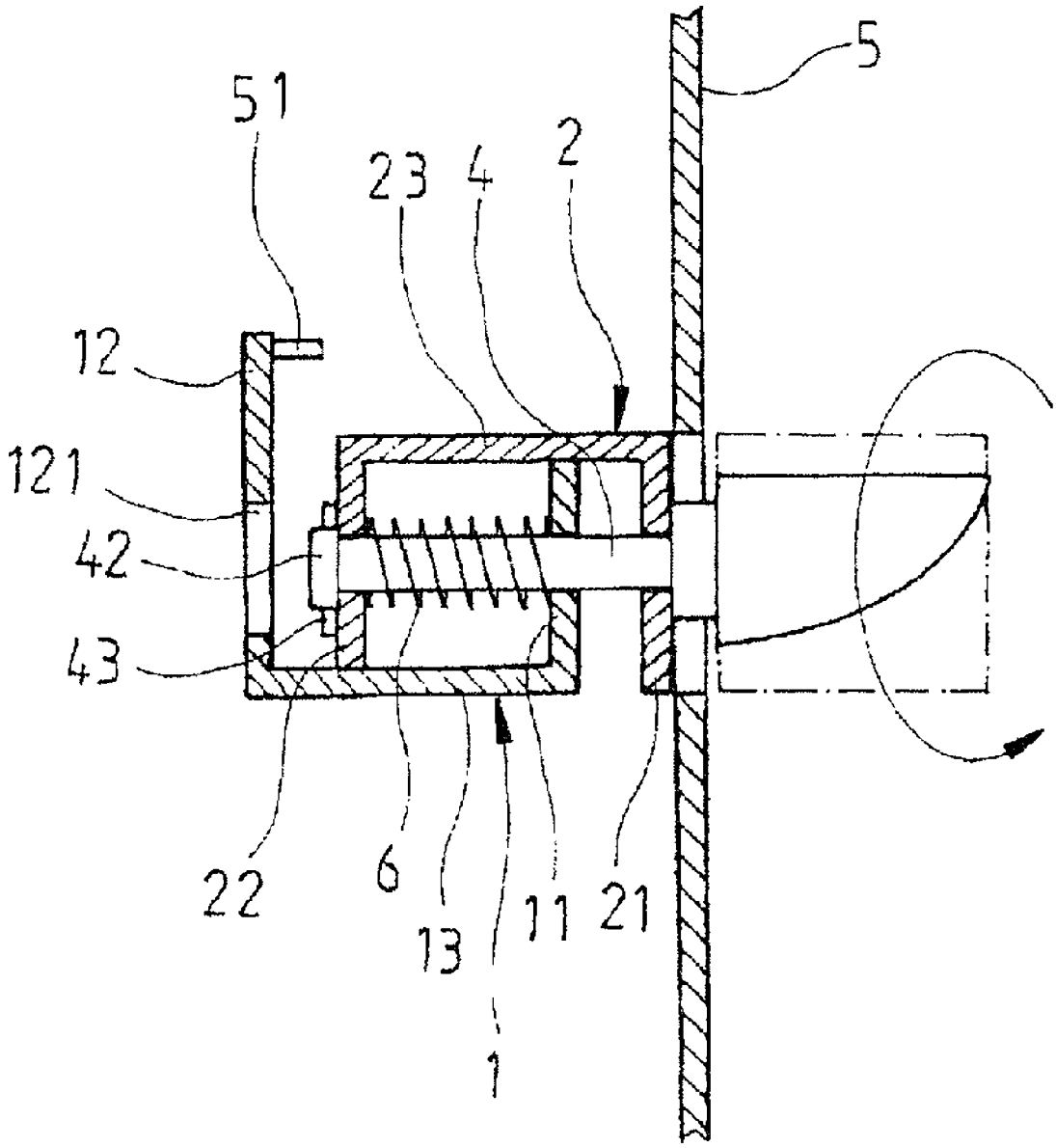
FIG. 5 is a cross-sectional view demonstrating a second phase of direction change operation of the latch direction change structure according to the present invention.

Referring to FIGS. 4 and 5, an operation of change of the direction of the present invention is shown. With further reference to FIG. 1, the present invention is fit for both leftward and rightward opening door, and the same lock can be modified by frontward pulling the latch 3 out of the lock case 5 and in pulling the latch 3 frontward, the fixed member 1 is retained by the retention member 51, so as to allow the expanded bar section 42 of the bar 4 to disengage from the through hole 121 for frontward movement of the movable member 2 along the fixed member 1 thereby disengaging the latch 3 completely from the case 5 and allowing the latch 3 to be rotated by 180 degrees (either in a forward direction or in a backward direction). Afterward, the latch 3 is released and the movable member 2 and the bar 4 are driven by the spring force of the spring 6 to return to the original position and properly position. Due to the fitting engagement between the positioning pegs 43 and the slots 122 of the rear vertical wall 12 of the fixed member 1, the latch 3 is prevented from being improperly positioned, such as inclined, after the modification is made, whereby the same lock is fit for leftward and rightward opening. There will no need to manufacture left-hand lock and right-hand lock separately and the manufacturing costs can thus be reduced.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A latch direction change structure of lock, comprising:

a fixed member, which comprises front and rear vertical walls and a horizontal connection wall connected between the front and rear vertical walls, the front vertical wall forming a through hole, the rear vertical wall forming a through hole having a larger diameter;

a movable member, which comprises front and rear vertical walls and a horizontal connection wall connected between the front and rear vertical walls, the front and rear vertical walls respectively forming through holes;

a bar, which has a front end coupled to a latch and a rear end forming an expanded bar section that is smaller in diameter than the through hole of the rear vertical wall of the fixed member; and a case having a retention member positioned against the rear vertical wall of the fixed member;

wherein the fixed member and the movable member are fit to each other in an opposing manner and the bar sequentially extends through the through holes of the fixed member and the movable member, a spring, and the through hole of the fixed member to be coupled to the latch, and wherein when the latch is pulled frontward with respect to the case, the movable member is caused to move along the fixed member to allow the latch to separate from the case for selective rotation of 180 degrees, whereby the lock is fit for both leftward and rightward opening operation, and wherein the through hole of the rear vertical wall of the fixed member has a circumference forming symmetrically arranged slots and wherein the expanded bar section of the bar forms symmetrically arranged positioning pegs, whereby when the bar is released to return to an original position, the positioning pegs are respectively fit into the slots for positioning to thereby prevent the latch from inclining.

2. The latch direction change structure according to claim 1, wherein the slots formed in the circumference of the rear vertical wall of the movable member and the positioning pegs formed on the expanded bar section of the bar are of a cruciform arrangement.

3. The latch direction change structure according to claim 1, wherein the bar has a front end forming a pin hole to receive a pin to extend therethrough for coupling to the latch.

* * * * *